United States Patent [19]

Steinway

[11] Patent Number: 4,898,355

[45] Date of Patent: Feb. 6, 1990

[54] SHELF SUPPORT FOR GLASS SHELVING

[76] Inventor: Steven Steinway, 5582 Greenbriar Dr., West Bloomfield, Mich. 48322

[21] Appl. No.: 297,173

[22] Filed: Jan. 17, 1989

[51] Int. Cl.[4] ..... A47G 29/02

[52] U.S. Cl. ..... 248/235; 211/90; 248/248; 248/250; 248/251

[58] Field of Search ..... 218/235, 247, 248, 250, 218/251, 239, 201; 108/107; 211/90

[56] References Cited

U.S. PATENT DOCUMENTS

| | | | |
|---|---|---|---|
| 1,778,075 | 10/1930 | Harris | 248/235 X |
| 3,484,069 | 12/1969 | Larson | 211/100 X |
| 4,374,498 | 2/1983 | Yellin | 211/182 X |
| 4,452,336 | 6/1984 | Sickler | 248/235 X |
| 4,804,159 | 2/1989 | Martel | 248/248 |

*Primary Examiner*—Ramon O. Ramirez

*Attorney, Agent, or Firm*—Arnold S. Weintraub; Roland W. Norris

[57] ABSTRACT

The present invention is a mounting structure for glass shelving or a glass wall panel. The mounting structure has a supporting bar which may be an elongated member or a U-shaped member, and an attachment bracket. The rod or bar is used to support the shelf or wall panel. The bracket attaches the supporting bar to a support surface, which is preferably an inner stud. The bracket is generally rectangular in shape, having an elongated hollow interior area for receiving and securing the supporting bar. The supporting bar can be mounted vertically on the stud, extending through a wall or can be directly mounted on the outer wall in either a vertical or horizontal orientation.

13 Claims, 1 Drawing Sheet

SHELF SUPPORT FOR GLASS SHELVING

BACKGROUND OF THE INVENTION

1. Field of the Invention

The present invention relates to a mounting structure for supporting shelving or a wall panel. The mounting structure employs a supporting bar and an attachment bracket which attaches the supporting bar to a support surface.

2. Prior Art

The prior art teaches various shelving arrangements and attachment fixtures. Generally, the shelves are metal or wood shelving supported by an attachment fixture appropriate for each type of shelf.

For example, U.S. Pat. No. 1,778,075 to Harris teaches a shelf support comprising a shelf having a bail attached to each end of the shelf wherein one bail is attached rigidly to one side of the shelf and the second bail is held slidably to the underside of the shelf by means of guide clamps. The support allows easy removal of the shelf.

U.S. Pat. No.3,484,069 to Larson teaches a base with a plurality of mounting prongs attached to the base by means of a bracket. This mounting support is primarily for mounting an apertured panel having holes arranged equidistantly in horizontal rows and vertical columns.

U.S. Pat. No. 4,374,498 to Yellin teaches a shelving apparatus comprising vertically spaced apart and horizontally spaced apart bars which are joined together to form a shelf. The apparatus is secured to a wall by means of mounting clips secured to the wall by screws.

As is known to those skilled in the art, particular problems are encountered in mounting glass panelling or shelving to a wall or the like. The fragile, slippery nature of a glass requires that the shelf or panel be securely mounted without breakage. However, the prior art has not addressed a method or means for safely supporting glass panels or glass shelving in abutment against a wall or ceiling surface.

The present invention, as will subsequently be detailed, is designed to securely mount glass wall panelling and shelving and employs methods and bracketry not found in the prior art.

SUMMARY OF THE INVENTION

The present invention provides a mounting structure for supporting glass shelving or a glass wall panel in abutment against a surface, such as a wall or the like, by means of a supporting member held to a support surface such as a wall or ceiling stud, through an attachment bracket. The attachment bracket, generally, comprises: (a) a pair of opposed angularly inclined legs, the incline terminating in an apex, thereby defining an interior hollow area and (b) a supporting member which is received and secured within the hollow area.

Each leg has a plurality of holes or apertures formed therein which receives fastening means for securing the legs to an associated stud.

The support member comprises an elongated bar extending in a plane, horizontal to the attachment bracket and perpendicular to the shelving or panel and, which, ordinarily, projects through a wall or the like. The bar may be cylindrical, oval or rectangular. Alternatively, the bar may be formed into a U-shaped bracket, wherein two attachment brackets may be used to secure the bar in place.

Likewise, the attachment bracket can be mounted directly onto a support surface comprising a wall or ceiling and the support rod may be bent to have a portion thereof nested in the hollow area below the apex.

The mounting structure may also comprise at least one trim ring or grommet insertable over the support bar to cover up the opening formed in the wall or similar structure.

For a more complete understanding of the present invention reference is made to the following detailed description and accompanying drawings. In the drawing, like reference characters refer to like parts throughout the views, in which:

DETAILED DESCRIPTION OF THE PREFERRED EMBODIMENT

Figure 1:
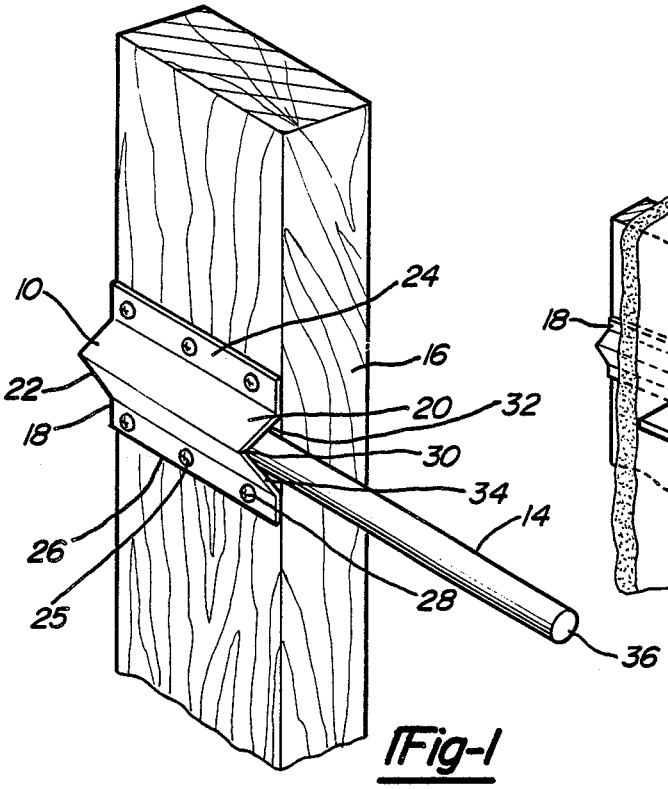
FIG. 1 is a perspective view of a mounting structure, in accordance with one embodiment of the invention.

Now, and with reference to the drawing, and as hereinabove noted, the present invention provides a mounting structure, generally, denoted at 10 for supporting shelving such as a glass shelf 12 or the like, by means of a supporting member 14 held to a support surface 16 by an attachment bracket 18. The attachment bracket 18 comprises a pair of legs 20, 22, each leg having at least one mounting flange 24, 26 having mounting holes 25 formed therein, for the receipt of a fastening means 28, such as a screw, bolt or the like. As shown in the drawing, the legs 20, 22 are angularly inclined with respect to each other. The incline terminates in an apex 30. The apex area has an interior surface 32 defining a narrow, elongated hollow area 34 which receives the supporting member 14 and is secured therein, as described hereinbelow.

The attachment bracket 18 attaches to the support surface 16 by the fastening means 28 which are inserted through the mounting holes 25 of the attachment bracket 18.

Figure 2:
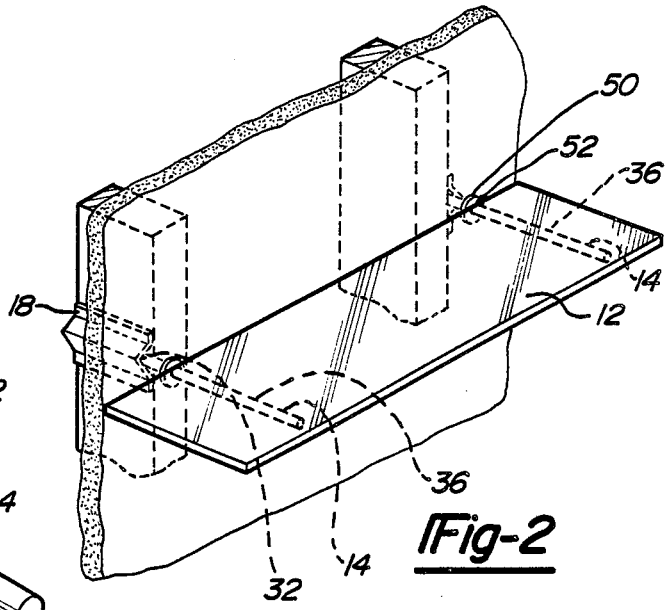
FIG. 2 is a perspective view of a wall panel mounting structure and attachment bracket attached to a support surface and showing the structure in use.

As shown in FIG. 2, in practicing the present invention, the attachment bracket 18 is secured to the support surface and one terminus of the supporting member 14 is inserted into the hollow area of the bracket 32 and securely retained therewithin. In a drywall environment the other end of the bar projects through a hole formed in the drywall 52 with the shelf 12 resting thereon. A grommet 50 can be used to finish off or cover the hole in the drywall 52 to provide a contiguous appearance in the wall covering. Ordinarily, a pair of bars 36 are used to support the shelf 12 which, then, seats on the supporting member(s) 14.

Figure 3:
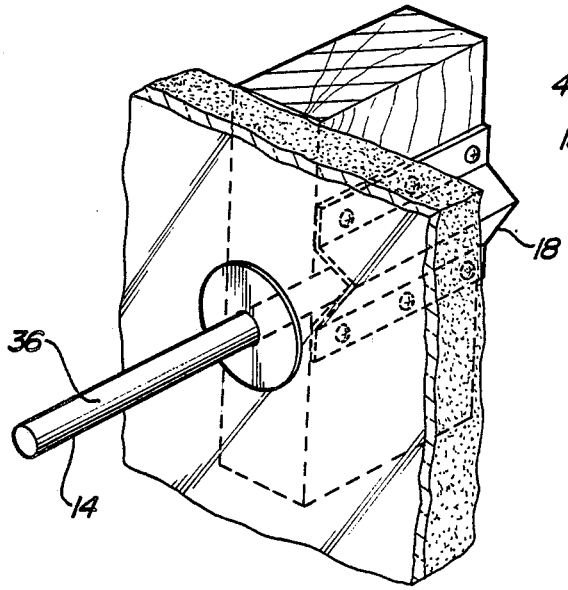
FIG. 3 is a perspective view of a finishing cap and support bar in accordance herewith.

As shown in FIG. 3, the supporting member 14 generally comprises an elongated bar 36 extending in a plane parallel to the attachment bracket 18 and perpendicular to the shelf or wall panel to be mounted. The bar may be rectangular, cylindrical or other suitable shape. The bar(s) may be oriented vertically or horizontally.

Figure 4:
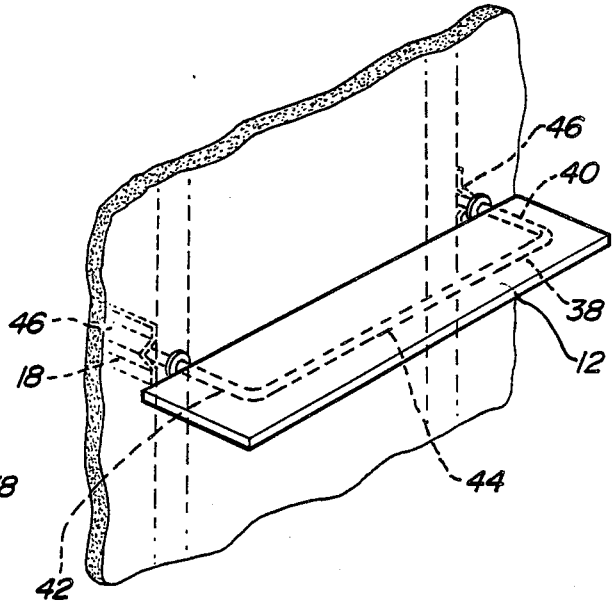
FIG. 4 is a perspective view of a alternate embodiment hereof.

Alternatively, and as shown in FIG. 4, the supporting member may comprise a generally U-shaped bracket 38 having a first member 40 and second member 42 which extend along a plane horizontal to the attachment bracket 18, wherein the two horizontally extending members 40, 42 are connected to a third member 44, the third member lying in a plane perpendicular to the two horizontal members and parallel to the shelf or wall panel to the mounted. The shelf 12, then rests on the supporting member 38. In this embodiment of the invention a pair of spaced apart attachment brackets 46 (shown in phantom) are employed.

The support surface comprises any planar surface to which the mounting structure is to be attached. A support surface may be a wall or ceiling stud, a wall or ceiling surface, furniture or cabinetry, upon which one wishes to mount a glass shelf or glass wall panel. Preferably, the support surface is a building wall stud to which the bracket attaches, in which case the supporting bar extends through the wall. Alternatively, the support surface may comprise a wall and the bracket may be mounted on, rather than through, the wall.

The supporting member may comprise, but is not limited to materials such as aluminum, stainless steel, acrylic and polycarbonate. The supporting member may be a hollow conduit or solid tubing. The member can be finished by means of polishing, brushing or painting. The end of the bar extending outward from the support bracket can be finished, machined or capped.

The mounting structure of the present invention is particularly useful for securely mounting glass shelving or mounting glass wall panels into abutment with a wall. Multiple mounting structures comprising the attachment bracket and support member may be mounted along a single horizontal plane for supporting a shelf. The supporting bar and attachment bracket may also be mounted along parallel horizontal planes to support a glass wall panel by the method set forth hereinabove. The ends of the support bars once in place may be finished, machined or capped for a more pleasing appearance.

Having, thus, described the invention, what is claimed is:

1. A mounting structure for supporting glass shelving comprising:

(a) an attachment bracket, the attachment bracket adapted to be mounted normal to a wall plane; the attachment bracket comprising a pair of legs, each leg having at least one mounting flange having at least one mounting hole formed therein, the legs being angularly inclined with respect to each other and terminating at an apex, the apex having an inner surface comprising an elongated hollow area;

(b) a supporting member, the support member being sized to be received and secured in the hollow area such that when secured the support member will extend therefrom normal to the wall plane and in a plane parallel to the attachment bracket; and, (c) fastening means for securing the bracket to a support surface, the fastening means being projectable through the mounting hole.

2. The mounting structure of claim 1 wherein the supporting member comprises a straight bar extending in a plane parallel to the attachment bracket.

3. The mounting structure of claim 1 further comprising:

(a) a pair of parallel spaced attachment brackets;

(b) the supporting member comprises a generally U-shaped bracket having a first and a second member which extend along planes parallel to the mounting brackets and wherein the two extending members are connected to a third member, which is perpendicular to the two extending members.

4. The mounting structure of claim 3 wherein the U-shaped supporting member comprises a cylindrical bar which extends from the attachment brackets.

5. The mounting structure of claim 1 further comprising a grommet, mountable on the support bar.

6. A mounting structure for supporting glass shelving from an inner stud of a wall, comprising:

(a) an attachment bracket, the attachment bracket adapted to be mounted normal to the wall on the inner wall stud, the attachment bracket comprising: a pair of legs, each leg having at least one mounting flange having at least one mounting hole formed therein, the legs being angularly inclined with respect to each other and terminating at an apex, the apex having an inner surface comprising an elongated hollow area;

(b) a supporting bar, the support bar being sized to be received and secured in the hollow area such that when secured the support member will extend therefrom normal to the wall plane and in a plane parallel to the attachment bracket; and, (c) fastening means for securing the bracket to a support surface, the support surface comprising an inner stud of a wall, the fastening means being projectable through the mounting hole in the wall.

7. The mounting structure of claim 6 wherein the supporting straight bar comprises a bar extending in a plane parallel with the attachment bracket.

8. The mounting structure of claim 6 further comprising;

(a) a pair of parallel-spaced attachment brackets; and, (b) the supporting bar comprises a generally U-shaped bracket having a first and a second member each extending along a plane parallel to the mounting bracket, wherein the two parallel extending members are connected to a third member, which is perpendicular to the first and second members.

9. The mounting structure of claim 8 wherein the supporting bar comprises a cylindrical rod adapted to extend from the attachment bracket, through a wall, in a plane horizontal to the ground.

10. The mounting structure of claim 6 further comprising a grommet, mountable on the support bar.

11. A mounting structure for supporting glass shelving comprising:

(a) a plurality of attachment brackets, each attachment bracket comprising:

a pair of legs, each leg having at least one mounting flange, the mounting flange having at least one mounting hole formed therein, the legs being angularly inclined with respect to each other and terminating at an apex, the apex having an inner surface comprising an elongated hollow area;

(b) a supporting member, the supporting member adapted to be received and secured in the hollow area, the supporting member comprising a generally U-shaped bracket having a first and a second member which extend along planes parallel to the mounting brackets wherein the two extending members are connected to a third member, which is perpendicular to the two extending members; and, (c) fastening means for securing each bracket to a support surface, the fastening means being projectable through the mounting hole.

12. The mounting structure according to claim 11 wherein the U-shaped bracket comprises a cylindrical bar.

13. The mounting structure according to claim 11 further comprising a pair of grommets mountable on the extending end members.

* * * * *